US005101613A

United States Patent [19]

Wilhelm et al.

[11] Patent Number: 5,101,613

[45] Date of Patent: Apr. 7, 1992

[54] APPARATUS FOR POSITIONING AND SHAPING A TUBULAR MEMBER OVER A CONTAINER

[76] Inventors: Thomas K. Wilhelm, 3 Red Ledge Dr., Dallas, Pa. 18612; Albert R. Rodriguez, 222 Lafayette Dr., Swedesboro, N.J. 08085; David S. Estock, 265 McLean St., Wilkes Barre, Pa. 18702

[21] Appl. No.: 526,293

[22] Filed: May 21, 1990

[51] Int. Cl.[5] ..... B65B 7/28

[52] U.S. Cl. ..... 53/567; 53/292; 53/295; 53/585

[58] Field of Search ..... 53/128, 291, 292, 295, 53/385, 567, 585, 293, 298, 385.1, 128.1

[56] References Cited

U.S. PATENT DOCUMENTS

| | | | |
|---|---|---|---|
| 2,771,725 | 11/1956 | Carter | 53/292 |
| 2,914,894 | 12/1959 | Hansen | 53/292 |
| 2,986,859 | 6/1961 | Eddison et al. | 53/292 |
| 4,162,601 | 7/1979 | Allen | 53/292 |
| 4,238,267 | 12/1980 | Konstantin | 53/292 X |
| 4,293,364 | 10/1981 | Fujio | 53/292 X |
| 4,481,064 | 11/1984 | Westlund | 53/292 X |
| 4,519,186 | 5/1985 | Winter et al. | 53/292 X |
| 4,537,014 | 8/1985 | Emmerling et al. | 53/385 X |
| 4,562,684 | 1/1986 | Dreher | 53/292 X |
| 4,914,893 | 4/1990 | Strub et al. | 53/292 X |

*Primary Examiner*—John Sipos
*Assistant Examiner*—Linda B. Johnson
*Attorney, Agent, or Firm*—Morgan & Finnegan

[57] ABSTRACT

A system for properly opening, shaping, orienting and positioning of bands in high speed banders. A number of jet nozzles are attached to moveable arms, which hold the bands during placement, and compressed gas is blown through these nozzles to open and shape the bands. A second set of nozzles are located on a guiding member which helps position and shape the band, and these nozzles guide bursts of compressed gas toward the inner back region of the band just prior to placement.

8 Claims, 4 Drawing Sheets

APPARATUS FOR POSITIONING AND SHAPING A TUBULAR MEMBER OVER A CONTAINER

BACKGROUND AND OBJECTS OF THE INVENTION

1. Field of the Invention

This invention relates generally to an apparatus for placing a band around an object, and more specifically to an apparatus for properly opening, shaping, orienting and positioning a band of shrinkable film as it is placed about a container.

2. Description of the Prior Art

The food, drug and cosmetics industries are becoming increasingly concerned with the possibility that unscrupulous persons may be able to tamper with products before they have been distributed to consumers. In many instances, tamperers open sealed containers, add injurious substances to these containers, reseal them, and replace them for eventual public consumption. Frequently, the tamperers obtain the product by buying it from retailers, and after the product has been adulterated, the tamperers surreptitiously replace the product on the retailers, shelves. To improve consumer safety, manufacturers and packagers now shrink a band of thin plastic film around the necks of their containers. This is commonly known as the "tamper-evident" seal. A would-be tamperer will be unable to open a sealed container without destroying the film seal. Even if the tamperer cuts the band from the container and glues it back on, there will be a fine line where the band was cut. A consumer therefore has an aid in determining whether the container he is considering buying has been unsealed by making sure that the band of film surrounding the cover opening is present and intact. Absence or mutilation of this band is an indication of possible product tampering and consumers are warned, usually on the container's packaging, not to use the material in any container which has a missing or mutilated band.

Today, tamper-evident seals are made by placing a somewhat oversize band of film around the region where a container and container top meet. These film bands are preferably made from heat-shrinkable polymers such as polyethylene or polyvinyl chloride. When placed around the container, the band is somewhat larger than the container. Once properly positioned around the container, the band is heated and shrinks to form a tight seal around the container's closure.

Many devices are known for placing bands of film around containers. Some such devices are disclosed in U.S. Pat. Nos.: 4,562,684; 4,286,421; 4,293,364; 4,184,309; 2,890,558 and 2,103,302. Most of these devices grab preformed bands of shrinkable film in vacuum suction jaws, and then move the jaws so that the band is properly placed about the container. These jaws only grip bands when connected to a vacuum; to release the bands, all that need be done is interrupt the vacuum.

The extent to which known heat-shrinkable films can be made to contract with aesthetic neatness upon heating is not all that great. This behavior means that the unshrunk film bands cannot be all that much larger than the container necks. Should the bands be made too large, then during heating they may not shrink enough to form a tight seal around the container. At the same time, if the bands are too close in size to the containers, there will be very little clearance between them and this may complicate band positioning. One reason to use unshrunk bands that are only slightly larger than the container being sealed is that only a slight amount of shrinkage will be needed to bring the band into contact with the container, and additional shrinkage will simply produce a very tight aesthetically neat seal that is very difficult to remove. Because in practice the clearance between unshrunk band and the container closure is not all that great, the bands have to be properly opened and shaped as they are positioned around containers. If the bands are not properly opened and shaped, they may brush against the containers as they move downward onto the containers. This may cause the bands to be misoriented on the containers. In addition, the mispositioned bands may jam between the vacuum jaws and the container, forcing the sealing machine operator to stop the banding machine so that he can clear the jam. Since a failure to properly open and shape shrinkable bands can result in poor product appearance or decreased production levels, there is a real need to keep the bands properly opened and shaped during placement.

Early band applicators carried pre-cut bands in magazines. One such device is disclosed in U.S. Pat. No. 2,103,302. The sealing machine disclosed in U.S. Pat. No. 2,103,302 employed several individual linear sealing assemblies arranged in series. Containers to be sealed moved past these sealing assemblies. A number of sealing assemblies were used, presumably because a single assembly was not capable of operating at a sufficient speed. By using more than one sealing assembly, machine output could be increased in direct proportion to the number of additional sealing assemblies.

In time, banders having band placement equipment mounted on rotary turrets were introduced. These devices were able to achieve increased banding rates because they moved the band placement equipment along with the moving containers. Such devices are disclosed in U.S. Pat. Nos. 2,890,558, 4,184,309, 4,293,364 and 4,562,684.

In order to make efficient use of packaging equipment, it is necessary to maximize the number of containers banded for a given period of time. In other words, it is desirable to operate the machinery at as high a speed as possible. At the same time, the machine cannot be run so fast as to cause machine failures, which these result in unproductive down-time when the equipment is idled for repairs.

One device for applying bands of shrinkable film to containers is disclosed in U.S. Pat. No. 4,562,684 the disclosure of which is incorporated herein by reference. This device carries several band positioning assemblies on a vertical rotary turret having a horizontal axis of rotation. Bands of film are grasped, opened and positioned around moving containers, all while moving around the horizontal axis. The bands are grasped by a pair of vacuum jaws which rotate with the turret. The bands are oriented so that once held in the vacuum jaws they continue to rotate downward until they are positioned around the container. The bands are released by interrupting the vacuum holding them in the jaws when the bands fully encircle the container necks.

The higher the speed at which banders operate, the more likely they are to experience band misorientation or jamming. At high banding rates, the collapsed bands have little time to open. Furthermore, the rapid movement of the bands from the grasping position to the placement position creates air drag, causing the opening band to buckle or bend.

It is always desirable to raise the banding rate; however, as this rate is increased, band positioning accuracy will ultimately decrease until the incidence of mispositioned or jammed bands becomes unacceptable. Thus, there exists a genuine need to improve band opening and shaping and the accuracy with which the bands are positioned regardless of the rate of banding.

OBJECTS OF THE INVENTION

It is therefore an object of this invention to provide an apparatus for accurately positioning a band of material about a container.

Another object of this invention is to provide an apparatus for improving the accuracy with which banding devices position bands of material about containers.

An additional object of this invention is to provide an apparatus which is capable of precisely positioning bands of material about containers regardless of the rate of banding.

Yet another object of this invention is to provide an apparatus for use with banding equipment which apparatus allows operators to vary the banding equipment production rate without having to readjust the positioning apparatus.

Still an additional object of this invention is to fully open and properly shape folded bands of material for accurate placement around a container.

Another object of this invention is to provide a device which opens, shapes and positions bands of material about a container without requiring excessive contact with the bands.

An additional object of this invention is to provide an apparatus which can improve the performance of banding equipment.

A further additional object of this invention is to provide an apparatus which produces an aesthetically neat sealed container.

SUMMARY OF THE INVENTION

The apparatus of the present invention can be used with various known types of banding equipment either of linear or rotary design. An example of the type of banding devices for which the apparatus of the present invention is intended is disclosed in U.S. Pat. No. 4,562,684.

The present invention includes the use of two principal assemblies which cooperate to open, shape and position the shrinkable band for proper placement. One, the band inflator, insures that each band opens fully and is properly shaped as it is being placed over the container. The other, the band-guide impulse unit, orients each band just before it is released from the vacuum jaws of the band inflator as the band descends onto the container and, together with the band inflator, helps keep the band open and properly shaped. Both of these assemblies use controlled bursts of pressurized gas, to open, shape and position the bands. One particular advantage of using bursts of gas to control the bands is that this avoids mechanical contact with the band, which can cause damage to the film bands.

In general, the present invention relates to an apparatus for applying a tubular member (band) over an article (container) passing along a path through said apparatus at an application station. Such apparatus comprises a source of tubular members, at least one pair of opposed movable gripping members, a vacuum source, transport means for the article, a source of pressurized gas and a guide member.

The opposed gripping members are movable between the source of tubular members and an application station of the apparatus. Each of said gripping members is movable towards each other as they are moved towards said source of tubular members such that said gripping members grip a tubular member from said source of tubular members and movable away from each other as they are being moved to the application station.

The vacuum source can be selectively applied to the opposed gripping members after they have gripped the tubular member and as said opposed gripping members are moved away from each other. In this manner, the tubular member is held between the opposed gripping members and opened. The vacuum source can also be selectively disconnected when the opposed gripping members are at the application station such that the tubular member is released therefrom and placed around the article.

A transport means transports the article to which the tubular member is to be applied to the application station.

At least one nozzle is connected to each pair of the opposed gripping members and each said nozzle is connected to a source of pressurized gas. In this way, gas can be provided to the nozzles to open and shape the tubular member gripped by the opposed gripping members. The gas can be provided to strike in front inner surface, the back inner surface or both the front and back inner surfaces of the tubular member.

A guiding member having a long axis, lying along the path through which the articles pass is also provided. The guiding member is dimensioned and disposed so that, as the tubular members are being placed about the articles at the application station the tubular members can be guided by said guiding member.

The guiding member is positioned adjacent to the application station immediately above a path of the tubular members.

A second source of pressurized gas is connected to the positioning nozzles on the guiding member and supplies gas to the positioning nozzle beginning before the tubular member is placed onto the article. The gas jet strikes a back inner surface of the tubular members.

Since the band inflator assembly and band guide impulse unit of the present invention can be used in conjunction with devices disclosed in the '864 patent, it will therefore be helpful to briefly describe the operation of the '864 patent machine.

In banding devices such as shown in U.S. Pat. No. 4,562,684, the shrinkable bands are carried by a pair of movable arms bearing vacuum jaws at their ends. These jaws grip a collapsed, flattened band and hold it between them by virtue of friction and a vacuum which is applied to openings on the jaws' facing inner surfaces. A plurality of pairs of arms are slidably mounted on a rotary turret which turns about a horizontal axis. This axis is perpendicular to the direction of travel of the items to be banded. The arms are supported so that they can move inward or outward in a direction parallel to the turret's axis of rotation. As the jaws spread apart, the band opens. The movement of the arms is controlled by a camming mechanism having two cams and which mechanism is located behind the rotary turret. The cam surfaces are designed so that when the vacuum jaws grasp a collapsed band at about the 12 o'clock position they are close together. As the turret rotates, the band is carried downward toward the container, and the cams cause the arms to slide so as to spread the jaws apart, opening the band.

Among the advantages of using cams to control jaw separation is that this system controls band spreading by virtue of the band's angular position relative to the turret axis, not its rotational speed. The turret can rotate at any speed and the arms will always be properly positioned.

Along with controlling arm movement, it is necessary to control when and for how long the vacuum is applied to the vacuum jaws. An especially advantageous mechanism for doing so is independent of rotational speed. Vacuum is applied to the jaws as they rotate past the position at which they grab a collapsed band, and is maintained until the open band has been placed onto a container. At this point, the vacuum is interrupted and the band is released.

The bander typically also includes a curved member which is located at the application station of the bander immediately above the path of the rotating bands. This member helps position the opened bands around the containers. As the bands held in the vacuum jaws rotate downward toward the containers, the upper edges of each band can be guided by the curved member and the contour of the member can force the band downward to a pre-determined level around the container.

However, depending upon the size of the bands being positioned, the space between these bands and the containers, the stiffness of the band material, and the device's speed of operation, the bands may not open fully and/or be properly shaped as the jaws spread.

For example, failure of the bands to open fully and/or be properly shaped can interfere with band placement around the container so that the bands will not be properly positioned. Similarly, the bands can jam against the containers, requiring machine operation be stopped.

The band-guide impulse unit of the present invention uses jets of pressurized gas to control band opening, shaping and orientation during placement around the container. Gas jets are used in place of mechanical means because they do not require physical contact with the band, reduce drag on the band, and are easy to control and adjust.

Also, in the present invention, each pair of arms carried, for example, on a rotary turret also carries a corresponding set of gas jet inflation nozzles. These jet nozzles insure that each band is fully opened and is properly shaped during placement. A set of such jets will hereinafter be referred to as a jet group. Positioning jets are also provided along the front edge of the present band-guide impulse unit These jets guide bursts of gas toward an approaching band which is carried toward impulse unit by the rotation of the turret and control the band orientation during the final stage of placement and, as an added benefit, help keep the band open and properly shaped. The two sets of jets on the pairs of arms and band-guide impulse unit can be pressurized by either a common gas supply or several independent supplies. The pressurized gas can be typically, air, nitrogen or a deionized gas.

The inflation jets, which are mounted on the arms and which blow the band open and shape it, can be controlled by a valve structure built into the banding device itself. In the case of a rotary design apparatus, this valve structure includes a flat plate lying directly behind and against the rotary turret. The flat plate can be made in two parts, each having a semicircular cutout, which allows the two parts to be clamped around a circular shaft that is itself stationary. The plate has a semicircular groove machined in its surface nearer the rotary turret. This groove communicates with a pressurized gas supply.

Bursts of gas can be produced by providing, at the appropriate time, compressed gas from a gas supply through flexible hoses to all the nozzles in a jet group on the arms. All the hoses of a single jet group on the arms are coupled to a single fitting, which in turn is coupled to the gas supply via a valve. This arrangement allows an entire group of jets to be activated simply by sending compressed gas through this one fitting.

The single fitting is joined to all the various hoses for a jet group. The fitting is rigidly mounted to the side of the rotary turret nearer the moving containers and it rotates along with the turret. A hole bored through the turret leads from the fitting to the bored openings in the back surface of the turret. The turret is positioned just adjacent to the grooved plate so that as the turret spins, the openings will rotate past the groove in the flat plate so as to periodically communicate with the pressurized gas supply.

In one embodiment of this invention, blocks are provided in the groove that allow an operator to adjust the length of the groove. By shifting the flat plate around the circular shaft, or changing the position of these blocks, the operator can adjust the radial positions where the gas jets begin and end. Ideally, the gas jets begin after the vacuum jaws have grasped the band, and end just as the band is being positioned around the container necks.

The present invention also uses pressurized gas jets to control band position as bands are placed onto the containers. This is done by mounting one or more jet nozzles flush with a surface of the band-guide impulse unit. These nozzles point rearward toward the approaching unbanded containers and descending opened bands carried by the rotating vacuum jaws. The nozzles are connected to a compressed gas supply via a regulating valve that controls when and for how long the gas jets blow. By using mechanical cams or suitable electronics to control these valves it is possible to produce a system that automatically adjusts the timing and duration of the gas jets so that the system gives optimum performance regardless of operating speed.

The air jets should begin before the band is fully-placed around the container. Ideally, the jets will strike the rearward inner surface of the band and this will shift it downward slightly onto the container.

DETAILED DESCRIPTION OF PREFERRED EMBODIMENTS

Figure 1:
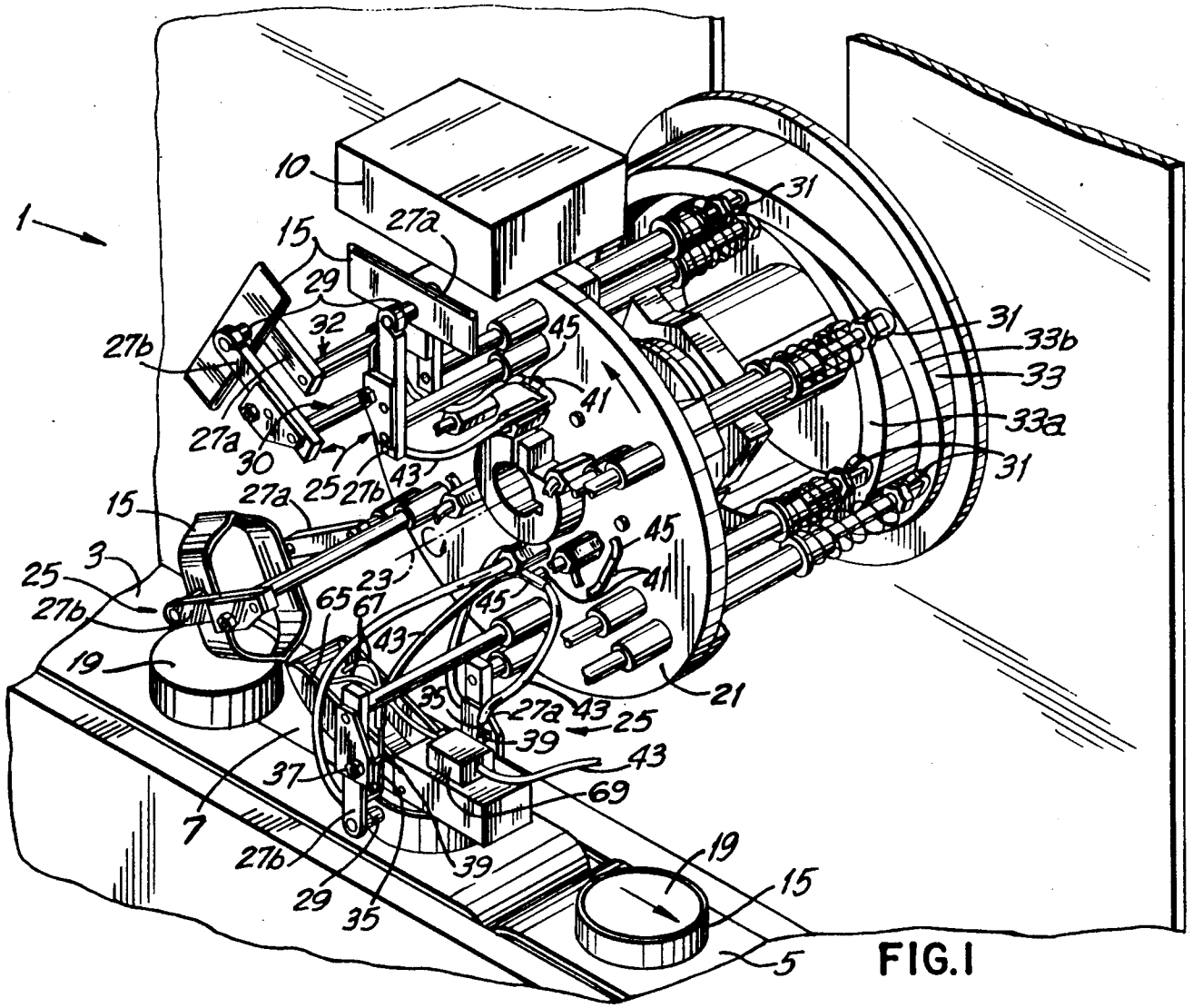
FIG. 1 is a perspective schematic view of an apparatus in accordance with one embodiment of the present invention
Figure 2:
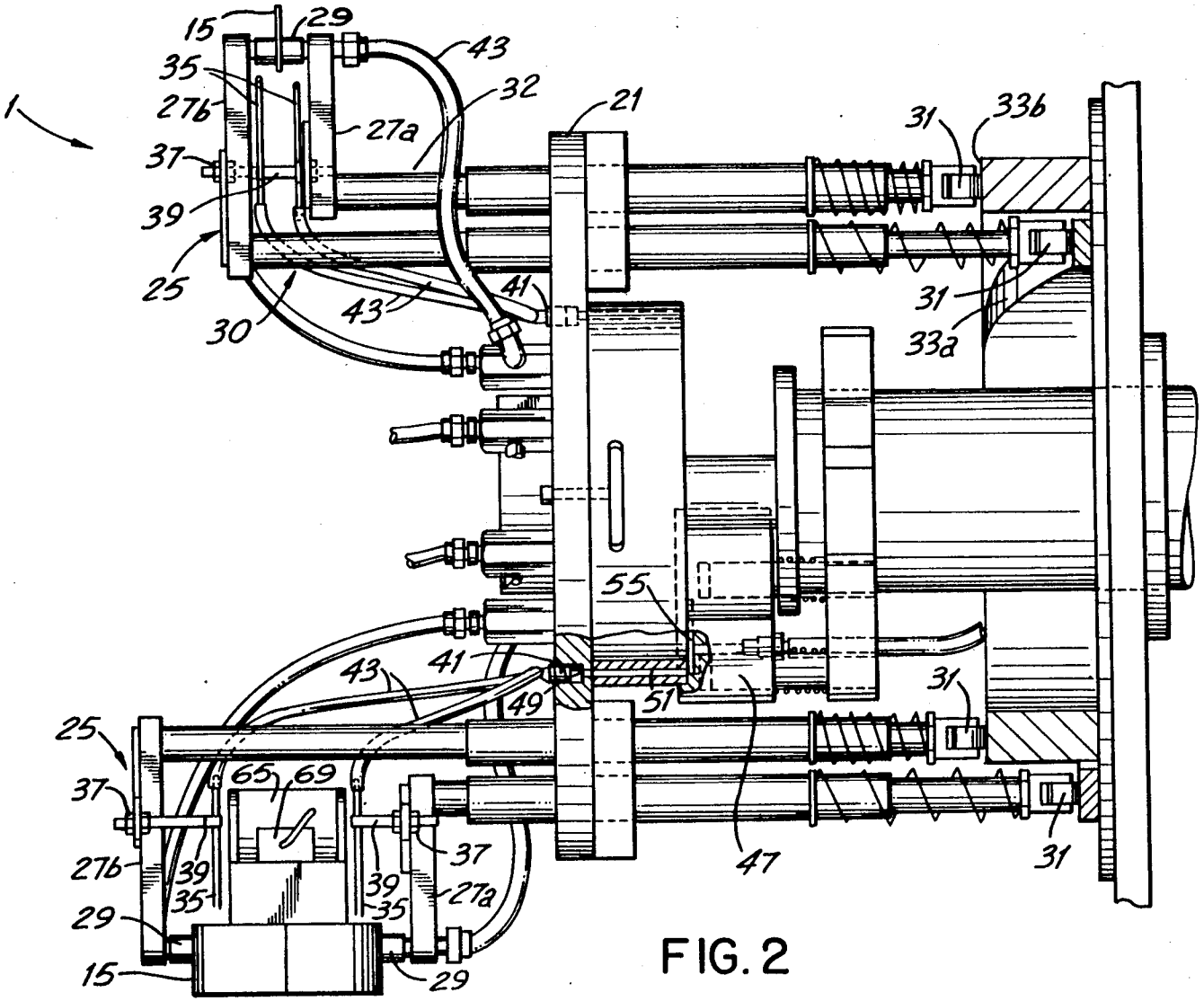
FIG. 2 is a side elevational view of the bank inflator system and band-guide impulse unit as mounted on the banding device of FIG. 1.
Figure 3:
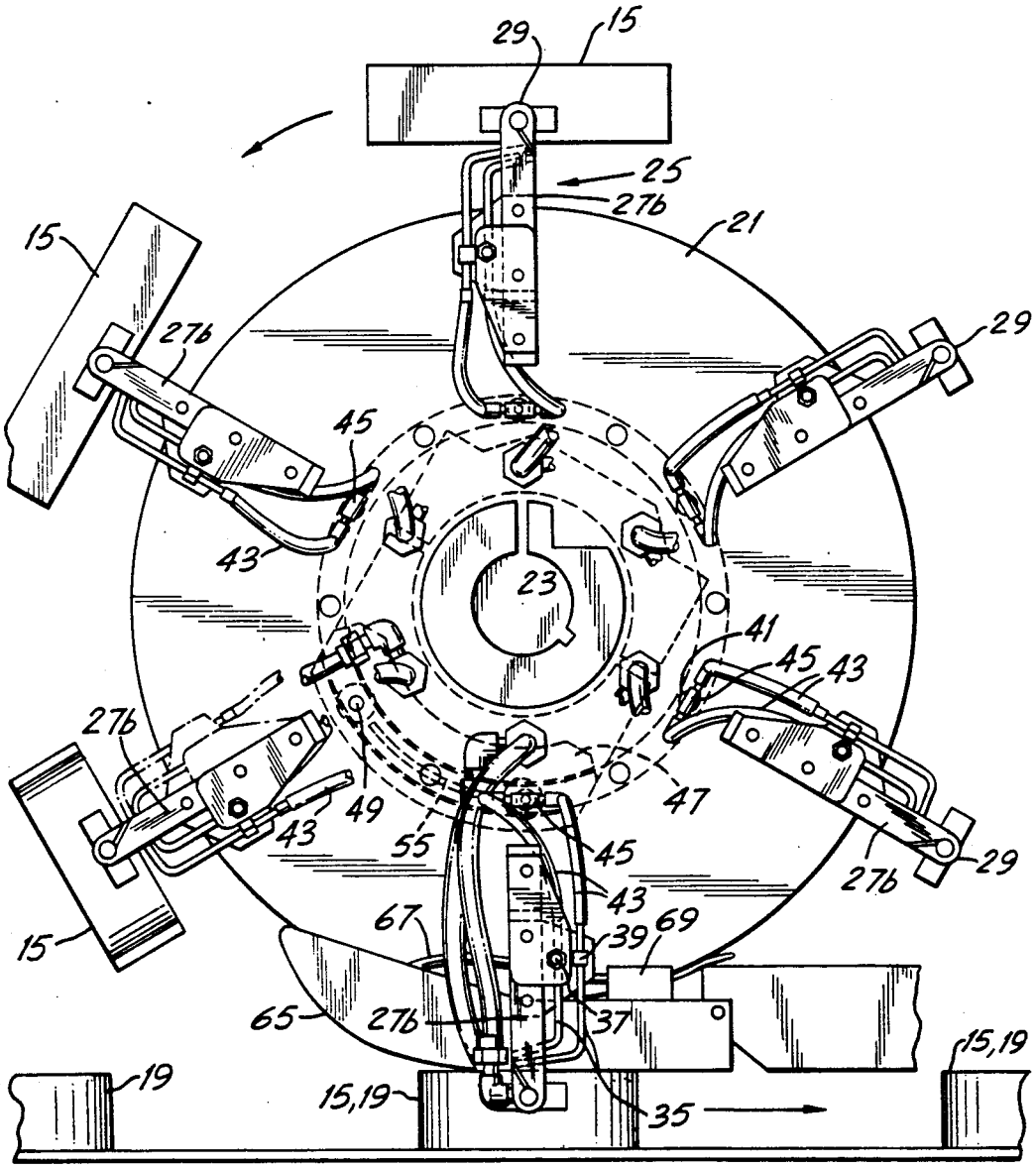
FIG. 3 is a front elevational view of the band inflator system as mounted on the banding device of FIG. 1.
Figure 4A:
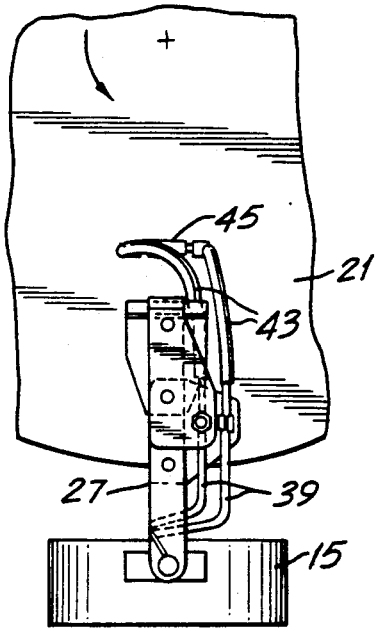
FIG. 4*a* and 4*b* are front and side elevational views, respectively, of a preferred jet group configuration that is used in the band inflator system.
Figure 4B:
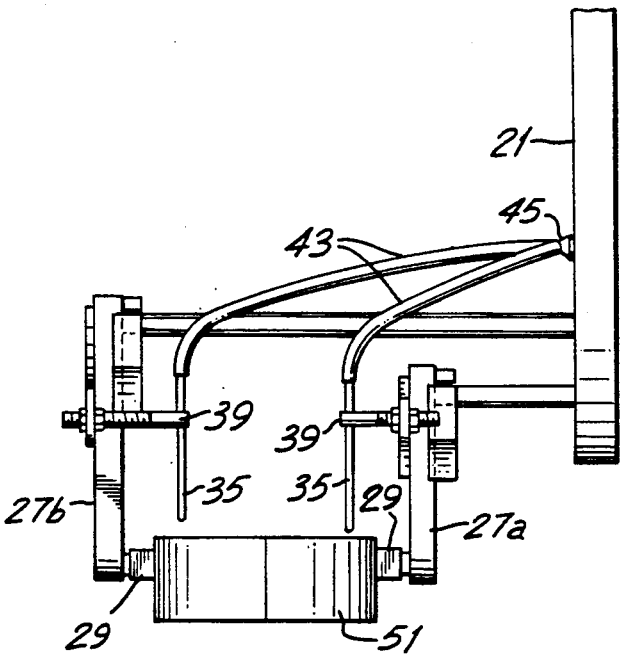

Referring now to the drawings and more particularly to FIGS. 1–2, there is illustrated a preferred embodiment of a band positioning system in accordance with the present invention. As here preferably embodied, the positioning system of the invention is advantageously adapted to help insure that the bands being placed about containers' necks by a banding machine are oriented properly. Such a system can be used as an adjunct to banding devices similar to those described in U.S. Pat. No. 4,562,684.

While the positioning system of the present invention as embodied herein is described in conjunction with the operation of the aforesaid type of banding device, it will be appreciated that the principles of operation are not limited to such usage and that the invention can be used in a variety of devices. However, since the invention is especially suitable for such use, reference will be made hereinafter thereto in order to provide an example of a practical and useful embodiment of the invention.

The banding machine 1 depicted in FIGS. 1–2 can either be incorporated into a container packaging system production line, or be a free-standing station separate from the production line and suited for batch operation. In either case, the containers 19 to be banded ar fed to the banding machine 1 atop a first conveyor 3 and, following banding, are then carried away on a second conveyor 5. The containers 19 are drawn from the first conveyor 3 past the banding machine by a timing screw 7. Each entering container 19 moves forward on the conveyor 3 until it sits in the root between two screw crests. As the timing screw 7 rotates, it draws the containers 19 forward past the banding machine 1. It has been found advantageous to increase the pitch between the screw teeth along the length of the screw so that the containers 19 accelerate as they approach the banding device and move at the same speed as do the bands 15 carried in the vacuum jaws 29. Once the containers are banded they are released from screw 7 and conveyed away via the second conveyor means 5 for further processing or storage..

The material used to form the shrinkable bands was supplied in the form of a long, collapsed tube of heat-shrinkable polymeric material wound onto a supply roll (not shown). As the collapsed strip of material unwinds, it passes over a wedge-shaped mandrel and then through several pairs of pinching rollers which fold the strip along its axis at right angles to its previous shape. The material is cut crosswise while still collapsed shut to form the bands 15 which are placed around the containers 19. This overall assembly is shown as the tubular member supply source 10 in the figures.

As carried on supply rolls, the collapsed tubular shrinkable material is so tightly wound that its edges are actually folded. The tubular material is opened by the wedge-shaped mandrel and passes through rollers which fold it along its axis at 90° to the existing folds. These new folds also resist opening, and even after the collapsed tube is cut they tend to prevent the bands 15 from opening fully.

The limited shrinkage of the heat-shrinkable film means that bands 15 cannot be substantially larger than the containers 19 about which they are being placed. It is quite important, therefore, that the bands 15 be accurately placed about the container necks.

Multiple band placement assemblies 25 are used to achieve higher banding rates. Typically, six to eight band placement assemblies 25 are used. All of these placement assemblies are mounted on a single rotating turret 21. Turret 21 is positioned above and to the side of the timing screw 7 and rotates about a horizontal axis 23 perpendicular to the direction in which the containers 19 travel. Turret 21 turns in the direction which causes the bottommost points on its circumference to move in the same direction as containers 19.

Each band placement assembly 25 consists of two moveable arms inner arms **27*a* and outer arm 27*b*. Each movable arm 27*a* and 27*b* is mounted on the turret 21 so that it can slide in a direction parallel to the turret's axis of rotation 23. Each pair of arms 27*a* and 27*b* is approximately parallel to the turret's axis of rotation 23**.

The end of each moveable arm **27*a* and 27*b* nearer the containers 19 projects outward over the containers. Each arm end carries a vacuum jaw 29, and these jaws are oriented so that they can grab the band 15 as it is cut. These vacuum jaws 29 are connected to a vacuum source (not shown) via tubing 71 and fitting 72** by a suitable control mechanism.

Moveable arms **27*a* and 27*b* are positioned so that as turret 21 rotates and the arms move upward, vacuum jaws 29 move toward each other. The jaw attached to the inner arm 27*a* is held by a question-mark shaped bracket 30 so that it faces toward turret 21, while the other jaw 29 on the outer arm 27*b* is held by an angle bracket 32 so that it faces away from turret 21. A folded band 15 is held in the path of jaws 29 so that the jaws pass on either side of the band. As the arms 27*a* and 27*b* near their uppermost position, jaws 29 are separated enough to pass around this folded band 15. Folded band 15 is grabbed by mechanical force between the band and the mating jaws 29 of arms 27*a* and 27*b*. After the band 15 is gripped by friction and the arms 27*a* and 27*b* move downward toward the containers 19 and move away from one another, a vacuum is drawn on jaws 29 to hold and open the band 15. The arms 27*a* and 27*b* continue rotating with the turret 21 and the band 15 moves downward toward the containers 19. By moving the inner arm 27*a* away from the turret 21 and the outer arm 27*b* toward the turret the vacuum jaws 29 spread away from another, opening the band 15** held between them.

The position of these movable arms **27*a* and 27*b* can be controlled by using cams. The end of each arm not carrying a vacuum jaw 29 carries a cam follower 31 and rides along a stationary circular camming surface 33 mounted behind the rotary turret. The cam's profile varies around its circumstance. Two camming surfaces, an inner 33*a* and outer 33*b*, are used, and these are coaxially located with respect to the turret's axis of rotation 23. The inner cam surface 33*a* controls the inner set of movable arms 27*a* and the outer cam surface 33*b* actuates the outer set of movable arms 27*b***.

The present invention employs a set of inflation jet nozzles 35 to blow the band 15 open and to shape the band 15 while the vacuum jaws 29 hold the band spread apart. One or more inflation nozzles 35 are mounted on each arm **27*a* and 27*b* by known fastening means such as bolts 37 and straps 39, and these nozzles are aimed to blow air onto the inner surface of the band 15 being held by the vacuum jaws 29. By mounting jet nozzles 35 on arms 27 they move apart along with the vacuum jaws 29, and this keeps the nozzles near the band 15**.

All the inflation nozzles 35 attached to one pair of movable arms **27*a* and 27*b* are coupled to a single fitting 41 by flexible, non-collapsible tubing 43. Where the jet configuration used provides two or more nozzles 35 per arm, it is advantageous to attach all the nozzles 35 for a single arm 27*a* or 27*b* to a Y-type connector 45 by flexible non-collapsible tubing 43. The two Y-connectors 45 for the two arms 27*a* and 27*b* are then joined to the single fitting 41 by more tubing 43. If only one jet is used per arm, they can be connected through tubing 43 to a single Y-fitting 45 directly attached to the single fitting 41**.

Besides providing a path to guide compressed gas to the nozzles 35, the length of time during which gas blows through the nozzles can be regulated. It is desirable that no gas flow through the nozzles 35 while the vacuum jaws 29 pick up the band 15, because that may shift the band and cause it to be improperly positioned in the jaws. If the band 15 is misaligned in the jaws 29 it will not be oriented properly when it is placed around the container 19. It is also desirable that the gas flow ceases by the time the band 15 is placed around the container 19. Should the gas flow continue as the vacuum jaws 29 release the band 15, the band may be buffeted and possibly misaligned. The present invention also involves the provision in a rotary design apparatus of a suitable mechanism for controlling when and for how long the compressed gas is supplied to the nozzles.

In the present embodiment, the gas flow begins as the arms 27*a* and 27*b* move downward past approximately the ten o'lock position, and continues until the arms reach approximately the six o'clock position, which is the point at which the vacuum jaws 29 release the band 15. Although a variety of well-known mechanisms such as cam or solenoid-actuated valves are capable of regulating the gas flow, this embodiment uses a special manifold structure having no moving parts other than the rotary turret 21.

In an especially preferred embodiment of the present invention the pressurized gas supplied blown through the nozzle groups 35 is regulated by a simple yet accurate control structure. In this mechanism, the single fitting's position in relation to the turret's axis of rotating 23 controls the gas supply. Such a valve is relatively speed-insensitive. Advantageously, the rate at which containers 19 are banded can be varied without requiring the operator to readjust the pressurized gas supply control mechanism.

Rotary turret 21 is rotatably mounted against a planar valve body 47. The turret 21 is provided with bores 49, each running all the way from a rearward opening 51 (which ultimately leads to the pressurized gas source, not shown) through the turret 21 to the single fitting 41 provided for each jet group 35. In the present invention, turret 21 is made in a hat shape with a solid brim area and a hollow crown. The bores 49 run through the crown and are spaced along the circumference on the turret coaxially aligned with the turret axis 23.

The planar valve body 47 located behind the rotary turret 21 is formed from two flat plates each having a semicircular groove along one straight edge. The two plates can be clamped together around a stationary hollow cylindrical shaft. The power shaft which drives the rotary turret 21 passes inside and along the axis of this shaft. The operator can vary the flat plates, angular position around the stationary shaft. One of the two flat plates has an arcuate groove 55 formed in its surface, and this arcuate groove lies along the circumference of a second circle on the turret that is coaxially aligned with the turret's axis of rotation 23. This arcuate groove 55 is connected to a source of pressurized gas, preferably by a bore 59 running through the back of the valve body 47. In one embodiment of this device the first and second circles are the same size, and so the bores 49 are parallel to the turret's axis of rotation 23. If the circles are not the same size then the bores 49 will instead be angled to form a truncated cone, in which the rearward bore openings 51 adjacent the planar valve body 47 all lie along a circle that is the same size as the second circle on which the groove lies. It is this alignment of the bores 49 and arcuate groove 55 that enables this structure to regulate gas flow.

As the turret 21 turns, each rearward bore 51 opening rotates around the valve body 47 until it sweeps across the arcuate groove 55. The arcuate groove 55 is continuously pressurized by the gas supply and it is filled with pressurized gas. As each rearward bore opening 51 moves along the arcuate groove 55, pressurized gas flows through the bore 49, to the corresponding jet group, and from there through the inflation nozzles 35 to strike the band 15. The rearward bore opening 51 continues turning and eventually passes beyond the end of the arcuate groove 55. At that point the flow of compressed gas through the bore 49 and jet group ceases.

In this embodiment the arcuate groove 55 runs between about the ten and six o'clock position when the valve body 47 is seen from the front. The angular position of this arcuate groove 55 can be easily changed by unclamping the two plates from the stationary circular shaft, rotating them around the shaft, and then reclamping them. By doing this the groove's position can be changed, for example, so that it now lies between about the eleven and five o'clock positions.

Band placement is guided by means of a band guide impulse unit 65. This structure is attached to the machine's frame and is positioned between the vacuum jaws 29. The curved member is narrow enough so that the jaws, as they release the bands, can rotate upward without striking it. As each spread band 15 rotates downward onto a container 19 its top edge can be guided by curved member 65. The curved member 65 is contoured so that the band 15 can be forced downward slightly.

Band placement is improved by urging the rear portion of the band 15 downward with a jet of air. The band-guide impulse unit 15 controls final band placement.

The band-guide impulse unit 65 includes two positioning jet nozzles 67 mounted in the impulse unit 65 and which are connected to a pressurized gas supply (not shown) through a suitable gas regulator. The regulator sends timed bursts of gas through the positioning nozzles 67 just as the rearward part of a band 15 passes the jets.

The positioning jet nozzles 67 mounted in the band-guide impulse unit 65 should be flush with or recessed from the surface of the plate so that the band edges can brush smoothly across the unit.

Pressurized gas is supplied from a gas source to the nozzles by conventional tubing 43. Preferably, the gas passes from a single supply tube through a "Y" or "T" connector 69 to nozzles 67. This simple delivery structure is especially advantageous because it insures the gas jets are approximately equal in size.

As noted, the gas supply is controlled so that the jets of gas strike the back inner surface of the band 15. The gas cannot flow continuously because it would also hit the front of each band 15, and this would cause the band to flex and possibly buckle. Numerous control structures lend themselves to regulating the gas flow.

One type of gas regulator is a spring-loaded toggle valve which is knocked open by the movable arms 27 as they sweep past and which valve then immediately snaps closed. While such a regulator is inexpensive it suffers from vibration and is not readily adaptable for use at different machine operating speeds. This can best be appreciated by comparing what happens when the banding rate is optimal, high and low. At "normal" speeds the arm 27 will sweep past the valve toggle and the triggered gas jet will strike the band 15 just before it is released from the vacuum jaws 29. If the banding rate slows, however, the turret 21 will not have turned enough after the toggle valve has opened to move the band 15 being placed into the proper position to be struck by the gas jet. The gas jet will puff out before the band 15 reaches the position at which it needs to be shifted by the jet and so the jet will have no effect. When the banding rate is high the reverse will occur; the arm 27 will rotate so quickly after striking the valve toggle that the band 15 will have been positioned around 9 the container 19 and released from the vacuum jaws 29 before the gas jet even strikes the band. Again, the lack of synchronization between valve actuation and banding rate will keep the gas jet from properly positioning the band.

An especially preferred embodiment of our invention uses an electronically-controlled valve to regulate gas flow to the positioning nozzles. The valve controller monitors both the turret's rate of rotation and its angular position. The controller is designed to adjust valve operation so that, regardless of turret speed, a properly-timed gas jet will always be produced. In practice this means that at high turret speeds the valve will open rapidly and well before the band nears the curved member, but need not stay open long. At slow speeds the valve need not open until just before the band strikes the curved member, and will remain open for a longer period. Such a valve controller also can be microprocessor controlled.

It will be understood that the present invention will work on a variety of shrinkable bands and can even be used with non-shrinkable bands. Likewise, the number of nozzles, their arrangement, and the choice of compressed gas to be used will be a matter of choice within the discretion of those persons having ordinary skill in the art.

The invention in its broader aspects is not limited to the specific embodiments herein shown and described, but departures may be made therefrom within the scope of the accompanying claims, without departing from the principles of the invention and without sacrificing its advantages.

We claim:

1. An apparatus for applying a tubular member over an article passing along a path through said apparatus at an application station comprising:

a source of tubular members;

at least one pair of opposed gripping members movable between said source of tubular members and an application station, each of said gripping members being movable towards each other as they are moved toward said source of tubular members such that said gripping members grip a tubular and movable away from each other as they are being moved to the application station;

a vacuum source which can be selectively applied to said opposed gripping members after they have gripped the tubular member and as said opposed gripping members are moved away from each other such that said tubular member is held between the opposed griping members and opened and which can be selectively disconnected when the opposed gripping members are at the application station such that the tubular member is released therefrom and placed around the article;

transport means for transporting the article to which the tubular member is to be applied to the application station;

a source of pressurized gas;

at least one nozzle connected to each pair of opposed gripping members and moving with the gripping member between said source of tubular members and the application station;

each said nozzle being connected to said source of pressurized gas such that gas can be provided to said nozzles to open and shape the tubular member gripped by the opposed gripping members.

a curved guiding member having a long axis, said long axis lying along the path through which said articles pass, said guiding member being dimensioned and disposed so that as said tubular members are being placed about said articles at the application station said tubular members can be guided by said guiding member;

said guiding member being positioned adjacent to the application station immediately above a path of the tubular members;

at least one positioning nozzle attached to said guiding member; and a second source of pressurized gas, said second source of pressurized gas being connected to said at least one positioning nozzle and being capable of supplying gas to the positioning nozzle beginning before the tubular member is placed onto the article, said gas striking a back inner surface of the tubular members.

2. An apparatus according to claim 1, further comprising:

a curved guiding member having a long axis, said long axis lying along the path through which said articles pass, said guiding member being dimensioned and disposed so that as said tubular members are being placed about said articles at the application station said tubular members can be guided by said guiding member;

said guiding member being positioned adjacent to the application station immediately above a path of the tubular members; at least one positioning nozzle attached to said guiding member; and a second source of pressurized gas, said second source of pressurized gas being connected to said at least one positioning nozzle and being capable of supplying gas to the positioning nozzle beginning before the tubular member is placed onto the article, said gas striking a back inner surface of the tubular members.

3. An apparatus according to claim 1, wherein said gripping members are disposed on a rotatable wheel member disposed between said source of tubular members and said application station such that the gripping members may be repeatedly conveyed in a circular path from the source of tubular members to the application station and back to the source of tubular members.

4. An apparatus according to claim 3, wherein the providing of pressurized gas from the source of pressurized gas is controlled by a control structure carried on the rotatable wheel members comprising:

a planar valve body having a flat front surface, said flat front surface having a groove, said groove connected to a pressurized gas supply, said planar valve body cooperating with said part of said apparatus which rotates to send periodic bursts of pressurized gas to said inflation nozzles.

5. An apparatus according to claim 4, wherein said groove is arcuate in shape.

6. An apparatus according to claim 5, wherein said planar valve body further comprises a first plate and a second plate, each said plate having an indentation whereby said plates can be fastened about a shaft.

7. An apparatus for opening, positioning, shaping and orienting a tubular member for placement over an article at an application station of an apparatus which places a tubular member about an article passing along a path through said apparatus comprising:

a pair of opposed gripping members movable between a source of tubular members and an application station, each of said gripping members being movable towards each other such that said gripping members can grip the tubular member from a source of tubular members and movable away from each other as the gripping members are being moved to the application station;

a vacuum source which can be selectively applied to said opposed gripping members after they have gripped the tubular member and ass said opposed gripping members are moved away from each other such that said tubular member is held between the opposed gripping members and opened and which can be selectively disconnected when the opposed gripping members are at the application station such that the tubular member is released therefrom and can rest around the article;

a source of pressurized gas;

at least one nozzle connected to each pair of opposed gripping members and moving with the gripping member between said source of tubular members and the application station;

each said nozzle being connected to said source of pressurized gas such that gas can be provided to said nozzles to open and shape the tubular member gripped by the opposed gripping members;

and a curved guiding member having a long axis, said long axis lying along the path through which said articles pass, said guiding member being dimensioned and disposed so that as said tubular members are being placed about said articles at the application station said tubular members can be guided by said guiding member;

at least one positioning nozzle attached to said guiding member; and a second source of pressurized gas, said second source of pressurized gas being connected to said at least one positioning nozzle and being capable of supplying gas to the positioning nozzle beginning before the tubular member is placed onto the article, said gas striking a back inner surface of the tubular members.

8. An apparatus according to claim 7, further comprising:

a curved guiding member having along axis, said long axis lying along the path through which said articles pass, said guiding member being dimensioned and disposed so that as said tubular members are being placed about said articles at the application station said tubular members can be guided by said guiding member;

at least one positioning nozzle attached to said guiding member; and a second source of pressurized gas, said second source of pressurized gas being connected to said at least one positioning nozzle and being capable of supplying gas to the positioning nozzle beginning before the tubular member is placed onto the article, said gas striking a back inner surface of the tubular members.

* * * * *